United States Patent [19]

Urai

[11] Patent Number: 4,995,926

[45] Date of Patent: Feb. 26, 1991

[54] METHOD OF MAKING A SEAT

[75] Inventor: Muneharu Urai, Akishima, Japan

[73] Assignee: Tachi-S Co., Ltd., Akishima, Japan

[21] Appl. No.: 383,232

[22] Filed: Jul. 19, 1989

Related U.S. Application Data

[62] Division of Ser. No. 179,838, Apr. 11, 1988, abandoned.

[51] Int. Cl.[5] ..... B32B 31/06; B32B 5/18

[52] U.S. Cl. ..... 156/78; 5/461; 5/171; 156/79; 156/155; 156/245; 156/289; 156/309.6; 156/321; 264/46.6; 264/321; 297/DIG. 1

[58] Field of Search ..... 5/448, 461, 471, 502; 156/78, 79, 155, 245, 309.6, 321, 289; 264/46.5, 46.6, 321; 297/DIG. 1

[56] References Cited

U.S. PATENT DOCUMENTS

| | | | |
|---|---|---|---|
| 3,101,436 | 12/1964 | Hood | 5/481 X |
| 3,675,970 | 7/1972 | Bereday | 5/481 X |
| 3,712,673 | 1/1973 | Swenson . | |
| 3,713,697 | 1/1973 | Koepke | 297/458 X |
| 4,107,829 | 8/1978 | Urai et al. . | |
| 4,114,213 | 9/1978 | Beernaerts et al. . | |
| 4,115,170 | 9/1978 | Sanson | 156/79 |
| 4,534,595 | 8/1985 | Abe et al. | 5/471 X |
| 4,618,532 | 10/1986 | Volland et al. | 5/481 X |
| 4,692,199 | 9/1987 | Kozlowski et al. | 156/245 |

FOREIGN PATENT DOCUMENTS

| | | | |
|---|---|---|---|
| 63383 | 10/1980 | Australia . | |
| 3230321 | 2/1984 | Fed. Rep. of Germany . | |
| 2470566 | 6/1981 | France | 5/471 |
| 2063065 | 6/1981 | United Kingdom . | |
| 2168606 | 6/1986 | United Kingdom . | |

*Primary Examiner*—Robert A. Dawson

*Attorney, Agent, or Firm*—Oldham & Oldham Co.

[57] ABSTRACT

In a seat for use in an automotive vehicle, a trim cover is bonded at least at its seat base partly only to a molded polyurethane foam functioning as a seat cushion member and is not substantially bonded at its flap and side parts to the molded polyurethane foam, so that an internal defect can be easily repaired by merely stripping off a corresponding portion of the trim cover. The trim cover may consist of a cover member only, or a filler pad may be only locally bonded to the cover member. The molded polyurethane foam may be formed by foaming and molding a polyurethane resin solution or may be supplied in the form of a slab.

2 Claims, 9 Drawing Sheets

METHOD OF MAKING A SEAT

This is a divisional of copending application Ser. No. 07/179,838 filed on Apr. 11, 1988 and now abandoned.

BACKGROUND OF THE INVENTION

1. Field of the Invention

This invention relates to a seat, and more particularly to a seat for use in an automotive vehicle.

2. Description of the Prior Art

There is an increasing demand for improving the function and design of a seat, especially, a bucket seat for use in an automotive vehicle, while, at the same time, a greatest possible reduction of the manufacturing cost of such a seat is also demanded. Thus, there is antinomy between these contradictory demands. The present invention is intended to deal with these antinomic demands. Examples of prior art seats to be improved by the present invention will first be described before describing the seat of the present invention, so that improvements made by the present invention can be clearly understood.

FIGS. 5*a* to 5*j* show examples of prior art seats. FIG. 5*a* or 5*b* is a schematic sectional view taken along the line Va—Va in FIG. 5*c* which is a plan view of a prior art seat. FIG. 5*a* shows that a trim cover 4 is bonded at its entire back surface to a molded polyurethane foam 1. This trim cover 4 is formed by previously lamination-bonding a filler pad 3 to a cover member 2. Black dots in FIG. 5*c* and short hatchings in FIGS. 5*a* and 5*b* indicate the spots or portions 5 where the trim cover 4 is bonded to the molded polyurethane foam 1. FIG. 5*b* shows that the trim cover 4 is composed of the cover member 2 only.

Such a prior art seat is made by the steps of placing the trim cover 4 at a predetermined position in a molding cavity of a foaming mold and foaming a polyurethane resin solution in the mold to form the molded polyurethane foam 1 integrally combined with the trim cover 4. Generally, impregnation or permeation of the polyurethane resin solution into the trim cover 4 during foaming is utilized to attain the desired bonding. However, when the trim cover 4 is thin as in the case of FIG. 5*b* , bonding utilizing the permeation of the polyurethane resin solution is not preferable.

When the seat is made according to such an integrally foaming and molding method, various defects as schematically shown in FIG. 5*d* occur frequently. A first defect is the occurrence of a fold 6*a*. FIG. 5*e* is an enlarged sectional view taken along the line *c-d* in FIG. 5*d* to show such a fold 6*a*. When a slack remains on a flap part of the cover member 2 at the time of manufacturing the seat, and the polyurethane resin solution is foamed to integrally combine the molded polyurethane foam 1 with the cover member 2 in such a state, the cover member 2 and the molded polyurethane foam 1 are bonded together while the fold 6*a* is formed on the cover member 2.

A second defect is the presence of a peeling portion or a floating portion as indicated at 6*b* in FIG. 5*d*. As best shown in FIG. 5*f* which is an enlarged sectional view taken along the line g-h in FIG. 5*d*, such a peeling or floating portion 6*b* occurs as a result of local insufficient bonding.

A third defect is the presence of a cave-in as shown at 6*c* in FIG. 5*d*. As best shown in FIG. 5*g* which is an enlarged sectional view taken along the line *e-f* in FIG. 5*d*, a portion of the molded polyurethane foam 1 directly beneath the cover member 2 is depressed during foaming and molding, resulting in formation of the cave-in 6*c*.

A fourth defect is the occurrence of a crease as shown at 6*d* in FIG. 5*d*. The detail of this crease 6*d* is shown in FIG. 5*h* which is an enlarged sectional view taken along the line *i-j* in FIG. 5*d*.

Because the trim cover 4 and the molded polyurethane foam 1 are firmly integrally bonded together, repair of these defects is impossible in most cases, resulting in the loss of the otherwise beautiful external appearance of the seat.

Further, when a side part A and a flap part B of the trim cover 4 are sewn together along a seam 10 as shown in FIG. 5*i*, part of the polyurethane resin solution tends to exude to the outside through this seam 10, resulting in exposure of a portion 1*a* of the molded polyurethane foam 1. Such external exposure is undesirable in that the beautiful external appearance of the seat is greatly impaired.

Further, a decorative groove or grooves 7 may be formed on a seat base part C of the seat from the design requirement, as shown in FIG. 5*d*. For the formation of such a groove 7, a foaming mold 8 having a corresponding convex portion 8*a* (FIG. 5*j*) is used during foaming and molding the polyurethane resin solution to make the molded polyurethane foam 1. However, that portion of the trim cover 4 may not be sufficiently shaped to conform to the shape of the convex portion 8*a* of the foaming mold 8, and the groove 7 may not have a sharply defined configuration. This is because the foaming pressure alone developed during foaming and molding the polyurethane resin solution to make the molded polyurethane foam 1 is not high enough to sharpen the contour of the corners of the groove 7, and a gap 9 tends to remain in that area.

Also, formation of a button-like pattern (as shown in FIG. 3*c*) may be required from the aspect of design. However, wrinkles around the buttons cannot be successfully produced when the trim cover 4 and the molded polyurethane foam 1 are entirely integrally bonded together.

SUMMARY OF THE INVENTION

It is an object of the present invention to solve all of the problems encountered with the prior art seats of the type described above.

The improved seat according to the present invention is featured in that the trim cover is bonded to the molded polyurethane foam, which is the cushion member of the seat, at substantially its seat base part only and is not bonded at its flap parts and side parts.

According to the present invention, the trim cover is not bonded to the molded polyurethane foam at its flap and side parts where a fold, a crease and/or a peeling or floating portion tend to frequently occur, so that the presence of these defects can be reliably prevented. Further, even when a cave-in may be formed in a part of the molded polyurethane foam obtained by foaming the polyurethane resin solution, such a defect can be easily repaired when the defect is present in the non-bonded part. Further, because the trim cover is not bonded to the molded polyurethane foam at its flap and side parts, the polyurethane resin solution does not exude to the outside through the seam between those parts.

DESCRIPTION OF THE PREFERRED EMBODIMENTS

FIGS. 1*a* to 1*d* show a first embodiment of the seat according to the present invention and its modification.

Figure 1A:
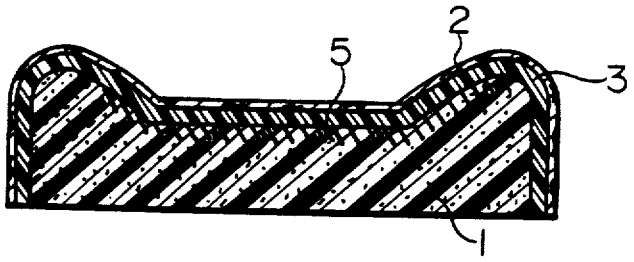
FIG. 1*a* is a schematic sectional view of a first embodiment of the seat according to the present invention.
Figure 1B:
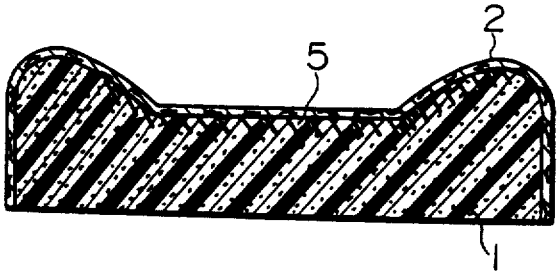
FIG. 1*b* is a view similar to FIG. 1*a* to show a modification in which the filler pad is not used.
Figure 1C:
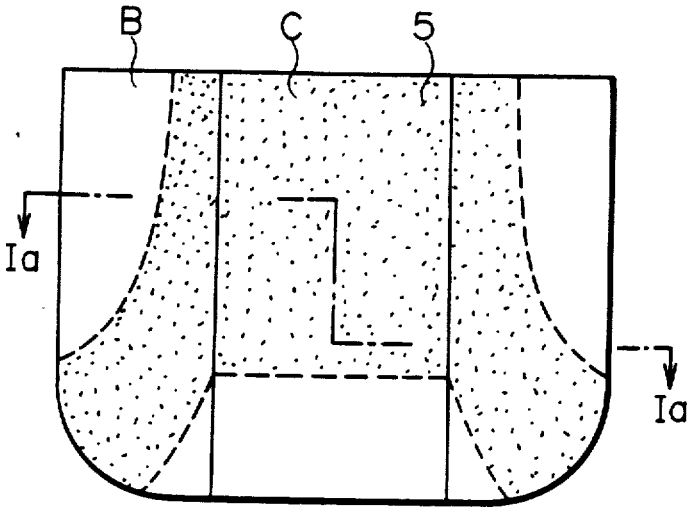
FIG. 1*c* is a schematic plan view of the first embodiment.

As shown in FIG. 1*c* which is a schematic plan view of the first embodiment shown in FIG. 1*a*, a trim cover is bonded to a molded polyurethane foam 1 at substantially its seat base part C and limited portions of its flap parts B ranging from the seat base part C to the front corners of the seat. That is, the trim cover (which is a laminate-bonded combination of a cover member 2 and a filler pad 3 in the case of the seat shown in FIG. 1*a*) is placed along a wall surface of a molding cavity of a foaming mold (not shown), and a polyurethane resin solution injected from above the trim cover in the mold is foamed and molded to form the seat shown in FIG. 1*a*. Before the injection of the polyurethane resin solution into the molding cavity of the mold, a film of an adhesive material (not shown) is previously disposed on an area of the trim cover corresponding to a bonded area 5, while a sheet of a non-adhesive material (not shown) is disposed on the remaining areas of the trim cover, and the polyurethane resin solution is foamed and molded to integrally combine the trim cover with the molded polyurethane foam 1 as described above. The adhesive material in film form is fused at the temperature of the mold during the step of foaming and molding and also at the foaming temperature of the polyurethane resin solution. After the molded polyurethane foam 1 is completed, the non-adhesive sheet is removed, and the integral assembly of the trim cover and the molded polyurethane foam 1 is subjected to heat treatment. As a result of this heat treatment, the adhesive material in film form melts into the molded polyurethane foam 1 and the filler pad 3, thereby forming the bonded area 5 which is permeable to air. When the trim cover includes the filler pad 3 as its lower layer, this bonding may be achieved by permeation of the polyurethane resin solution into the filler pad 3 at the time of foaming and molding. In such a case, a hard layer formed by permeation of the polyurethane resin solution may be required as compared to the case where the adhesive material in film form is used. Also, in the case where the technique of high-speed foaming is employed to foam and mold the polyurethane resin solution, the non-adhesive sheet may be unnecessary because no permeation of the polyurethane resin solution occurs.

FIG. 1*b* shows that the trim cover consists of the cover member 2 only.

Figure 1D:
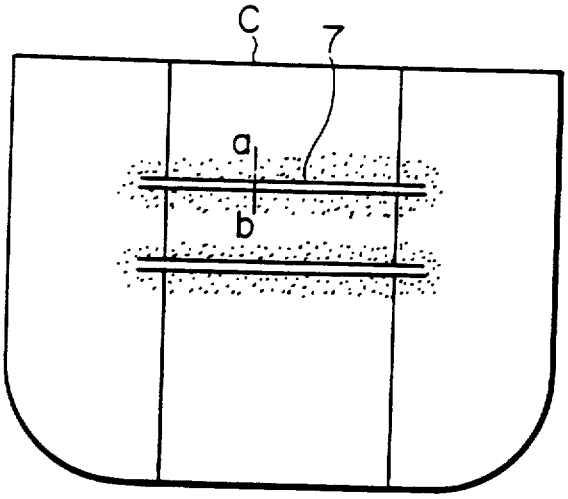
FIG. 1*d* is a view similar to FIG. 1*c* to show grooves provided on the trim cover.

When decorative grooves 7 are to be formed on the seat base part C of the trim cover from the design requirement as shown in FIG. 1*d*, the corresponding portions of the trim cover are previously pressed to be shaped into the form of these grooves 7. The trim cover having these grooves 7 of sharp configuration previously provided thereon is positioned in a molding cavity of a foaming mold 8*a* having a convex portion 8*a* which is complementary in shape to each of the grooves 7 as shown in FIG. 2*e*, and the molded polyurethane foam 1 is integrally combined with such a trim cover by foaming and molding the polyurethane resin solution in the foaming mold 8. In this manner, the decorative grooves 7 having sharp corners free from deformation can be formed.

Figure 5A:
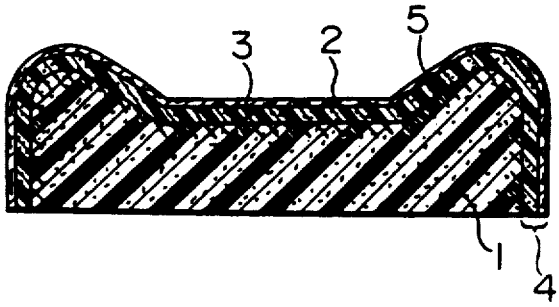
FIG. 5a Prior Art
FIG. 5*a* is a schematic sectional view of a prior art seat.
Figure 5B:
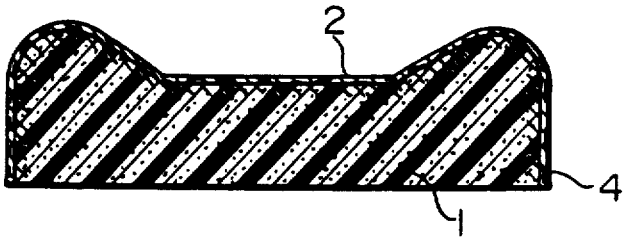
FIG. 5b Prior Art
FIG. 5*b* is a view similar to FIG. 5*a* to show a modification in which the filler pad is not used.
Figure 5C:
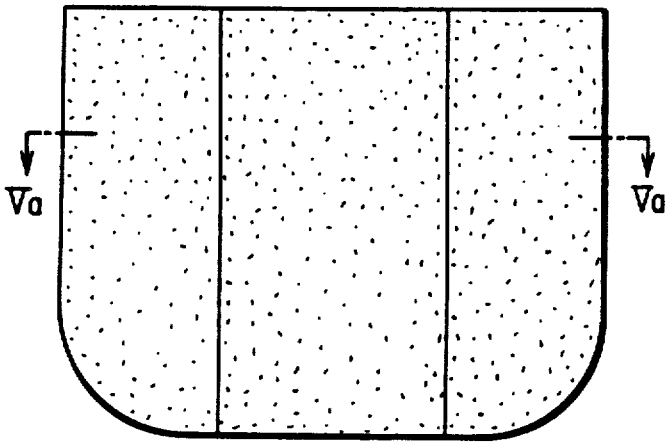
FIG. 5c Prior Art
FIG. 5*c* is a schematic plan view of the prior art seat.
Figure 5D:
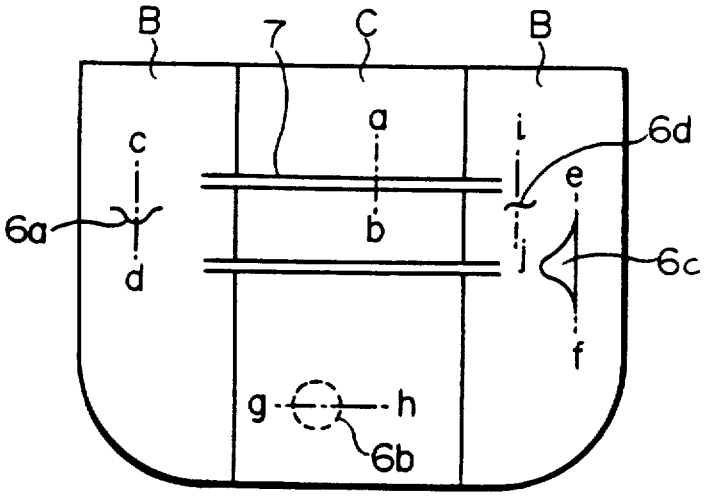
FIG. 5d Prior Art
FIG. 5*d* is a view similar to FIG. 5*c* to show grooves formed on the prior art seat.
Figure 5E:
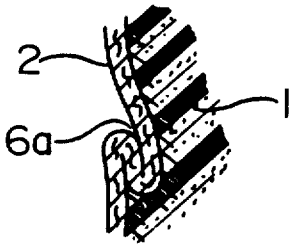
FIG. 5e Prior Art
FIGS. 5*e*, 5*f*, 5*g* and 5*h* are enlarged schematic sectional views taken along the lines c-d, g-h, e-f and i-j in FIG. 5*d* respectively.
Figure 5F:
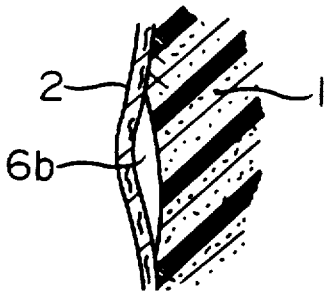
FIG. 5f Prior Art
Figure 5G:
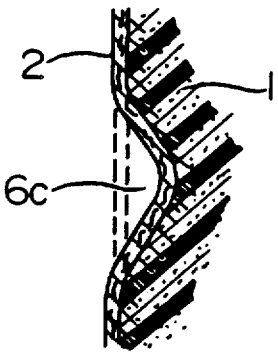
FIG. 5g Prior Art
Figure 5J:
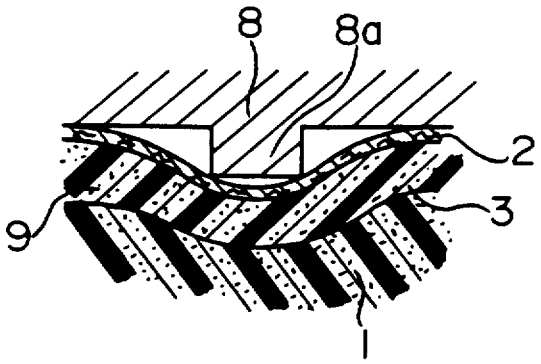
FIG. 5j Prior Art
FIG. 5*j* is a schematic sectional view showing means for forming the groove on the prior art seat.
Figure 5H:
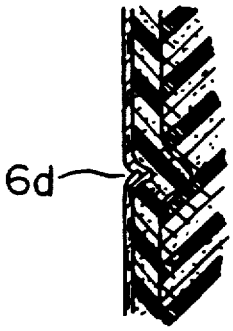
FIG. 5h Prior Art

Thus, when the trim cover is entirely bonded at least at its seat base part C to the molded polyurethane foam 1 and is not substantially entirely bonded at this flap parts B and its side parts A as described above, a fold 6*a*, a peeling portion or a floating portion 6*b* and a crease 6*d* as described with reference to FIG. 5*d* do not occur. Even when a cave-in 6*c* may appear in one of the flap parts or side parts after the molded polyurethane foam 1 has been formed, such a defect can be easily repaired by stripping off the corresponding portion of the trim cover.

The seat is greatly deformed when an occupant sits on the seat. Thus, even when a fold as shown at 6*d* in FIG. 5*d* may not occur, a crease as shown at 6*d* in FIG. 5*d* may possibly occur. When the seat is of the bucket type of large size, and the occupant repeatedly sits on the seat, the crease 6*d* may remain permanently thereby greatly impairing the beautiful external appearance of the seat. However, according to the seat of the present invention in which the flap parts B of the trim cover are not substantially entirely bonded to the molded polyurethane foam 1, such a crease would not occur because the flap parts B of the trim cover are freely movable.

On the contrary, unless the seat base part C of the trim cover is completely bonded to the molded polyurethane foam 1, the portion of the cover member serving as the seat base part C of the seat will be gradually stretched and slackened to finally produce a fold when the occupant repeatedly sits on the seat. In the seat of the present invention, there is no possibility of producing such a fold, because the trim cover is firmly bonded at tis seat base part C to the molded polyurethane foam 1.

FIGS. 2*a* to 2*e* show a second embodiment of the seat according to the present invention and its modification. In FIGS. 2*a* to 2*e*, the same reference numerals are used to designate the same parts appearing in Figs. 1*a* to 1*d*. In the second embodiment and its modification, the bonded area 5 is limited to the seat base part C of the trim cover.

Figure 2A:
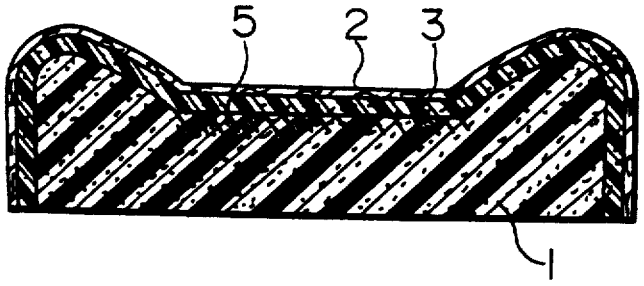
FIG. 2*a* is a schematic sectional view of a second embodiment of the seat according to the present invention.
Figure 2B:
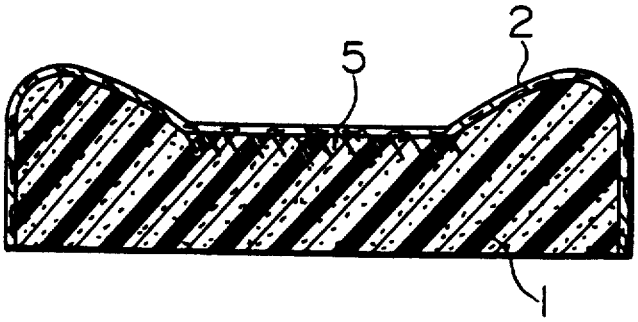
FIG. 2*b* is a view similar to FIG. 2*a* to show a modification in which the filler pad is not used.
Figure 2C:
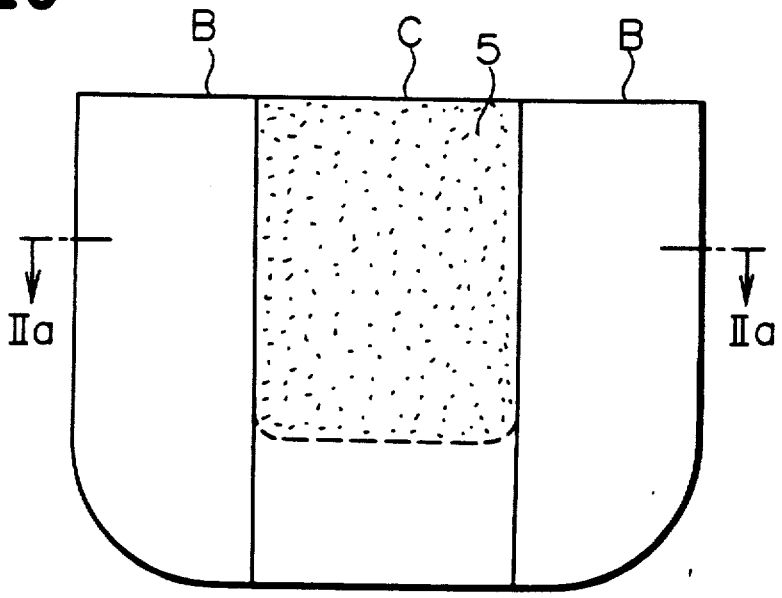
FIG. 2*c* is a schematic plan view of the second embodiment.
Figure 2D:
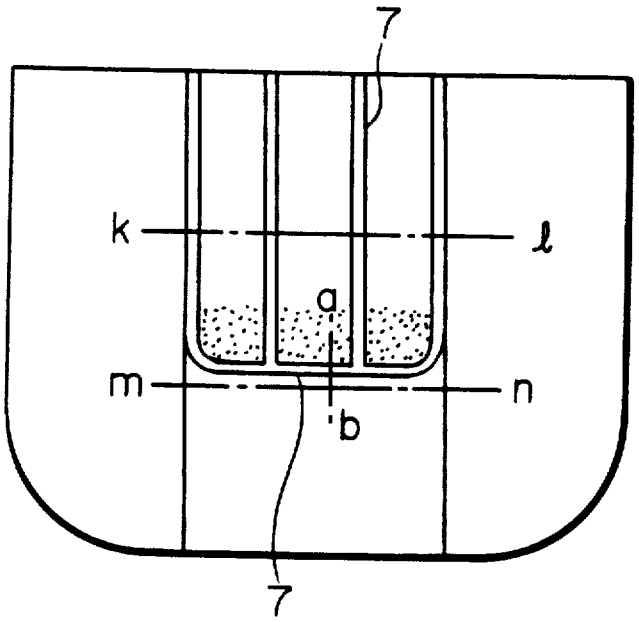
FIG. 2*d* is a view similar to FIG. 2*c* to show grooves provided on the trim cover.
Figure 2E:
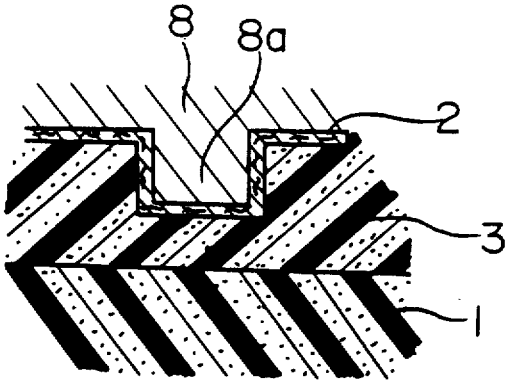
FIG. 2*e* is an enlarged schematic sectional view taken along the line a-b in FIGS. 1*d* and 2*d*.

Grooves 7 shown in FIG. 2*d* are formed in a manner similar to that described in the first embodiment with reference to FIG. 2*e*. However, in FIG. 2*d*, the developed length of a section *k*-1 of the trim cover is larger than that of another section *m-n*. Therefore, the section *m-n* of the trim cover may shrink to produce a fold at that section. When there is possibility of occurrence of such a fold, the bonded area 5 is preferably extended to the neighborhood of the section *m-n* so as to prevent occurrence of such a defect.

Figure 5I:
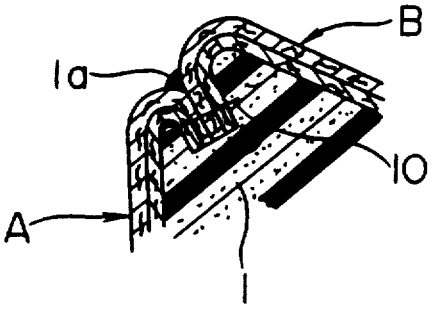
FIG. 5i Prior Art
FIG. 5*i* is an enlarged schematic sectional view of the boundary between the flap part and the side part of the prior art seat.

External exudation of the polyurethane resin solution through the seam 10 shown in FIG. 5*i* can be prevented according to the second embodiment in which a non-adhesive sheet as described already is temporarily disposed to cover the seam, and the polyurethane resin solution is then foamed. The above applies also to the first embodiment. This non-adhesive sheet is also used to prevent external exudation of the polyurethane resin solution through the seam between the flap part B and the seat base part C having different colors selected from the design requirement.

Further, when the non-adhesive sheet is sewn together with the seam 10, the non-adhesive sheet bites into the stitches, thereby preventing external exudation of the polyurethane resin solution through the stitches and facilitating mounting of the non-adhesive sheet. After foaming the polyurethane resin solution, the non-adhesive sheet can be removed from the seam 10 due to the presence of the perforations formed by the sewing machine. Further, if the joint between the flap part B and the seat base part C of the trim cover having the respectively different colors is located in the bonded area 5, a film of an adhesive material as described already is preferably used so as to prevent external exudation of the polyurethane resin solution through the perforations.

FIGS. 3*a* to 3*h* show a third embodiment of the seat according to the present invention and its modifications, and, in FIGS. 3*a* to 3*h*, the same reference numerals are used to designate the same parts appearing in FIGS. 1*a* to 1*d*. In the third embodiment and its modifications, the filler pad 3 is bonded to the molded polyurethane foam 1 at its portion corresponding to the seat base part C only of the trim cover. In the seat shown in FIG. 3*a*, the location of the filler pad 3 is limited to the seat base part C of the trim cover, and the bonded area 5 exists between the filler pad 3 and the molded polyurethane foam 1. In the modification shown in FIG. 3*g*, the cover member 2, filler pad 3 and molded polyurethane foam 1 are bonded together at the area of the seat base part C only of the trim cover. At the flap parts and side parts of the trim cover, a gap 11 is formed between the cover member 2 and the filler pad 3. Although not shown in Fig. 3*g*, there may be a gap between the filler pad 3 and the molded polyurethane foam 1. In the other modification shown in FIG. 3*h*, another filler pad 3' underlying the seat base part C only is provided besides the filler pad 3, and the cover member 2 and the filler pad 3, the filler pad 3 and the filler pad 3', and the filler pad 3' and the molded polyurethane foam 1 are bonded to each other at respective bonded areas 5'', 5' and 5 corresponding to the seat base part only. The filler pad 3' may be an integral part of the filler pad 3.

Figure 3A:
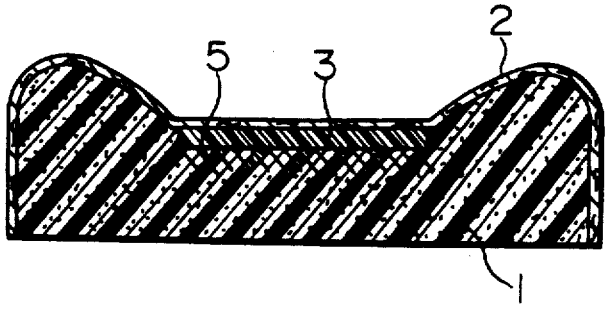
FIG. 3*a* is a schematic sectional view of a third embodiment of the seat according to the present invention.
Figure 3B:
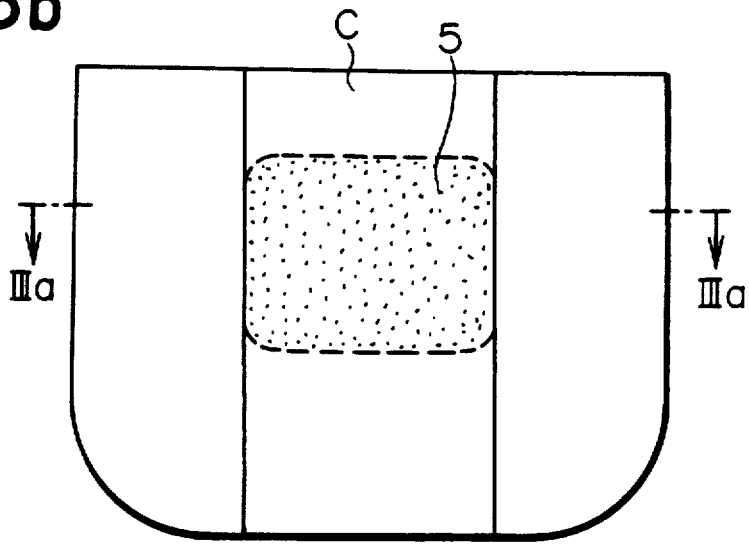
FIG. 3*b* is a schematic plan view of the third embodiment.
Figure 3C:
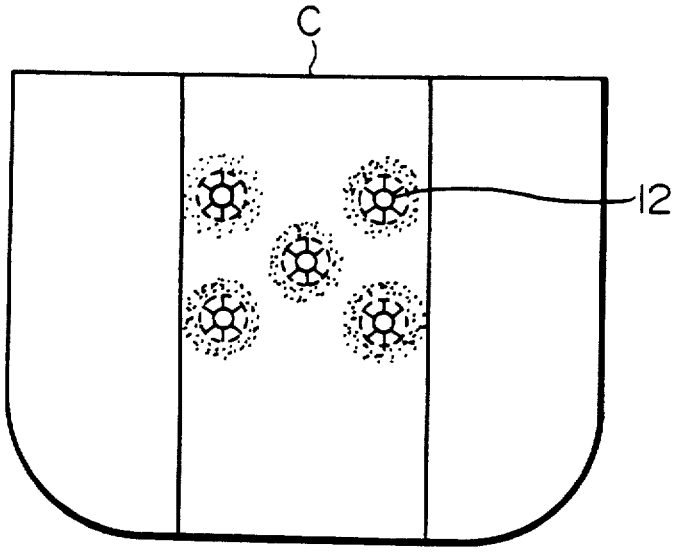
FIG. 3*c* is a view similar to FIG. 3*b* to show decorative buttons formed on the seat base part of the trim cover of the seat shown in FIG. 3*a*.
Figure 3D:
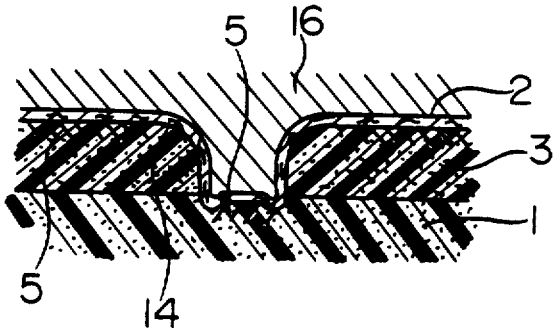
FIG. 3*d* is a schematic enlarged sectional view showing one of the buttons together with a corresponding portion of a shaping mold.
Figure 3E:
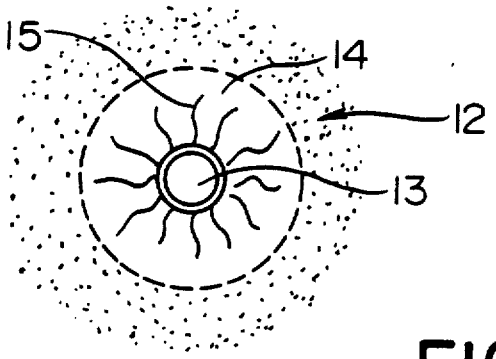
FIG. 3*e* is an enlarged schematic plan view of the area of the seat base part formed with the button.
Figure 3F:
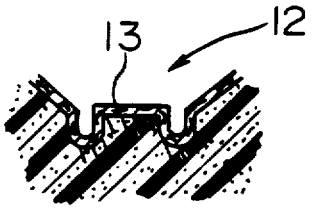
FIG. 3*f* is an enlarged sectional view of the central portion of the button.
Figure 3G:
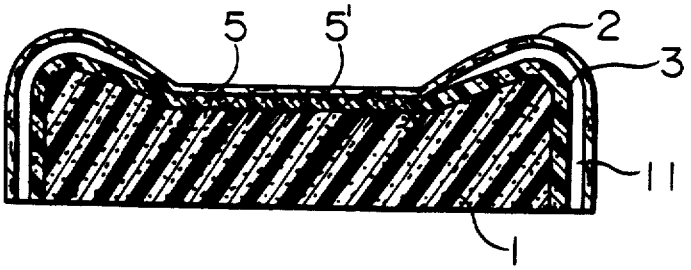
FIG. 3*g* is a schematic sectional view of a first modification of the third embodiment.
Figure 3H:
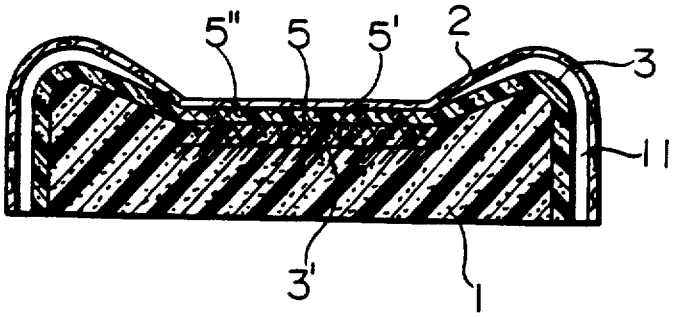
FIG. 3*h* is a schematic sectional view of a second modification of the third embodiment.

FIG. 3*c* is a schematic plan view similar to FIG. 3*b* to show a plurality of decorative buttons 12 formed on the seat base part of the trim cover of the seat shown in FIG. 3*a*. FIG. 3*d* is an enlarged schematic sectional view showing one of the buttons together with a corresponding portion of a shaping mold, Fig. 3*e* is an enlarged plan view of the area of the seat base part formed with the button, and FIG. 3*f* is an enlarged sectional view of the central portion of the button. A shaping mold 16 having a plurality of convex portions is used to press the associated portions of the trim cover thereby forming the respective buttons 12. It will be seen in FIG. 3*d* that the portion of the cover member 2 forming the central portion 13 of the button 12 is bonded to the molded polyurethane foam 1, but the circular portion of the cover member 2 adjacent to the central portion 13 of the button 12 is not bonded to the filler pad 3 as shown at 14. Alternatively, the trim cover having the buttons 12 previously shaped as by high frequency processing is placed at a predetermined position in a lower foaming mold having corresponding complementary convex portion, so that the buttons 12 can be accurately shaped into the desired form. When the buttons 12 are formed in the manner described above, many natural wrinkles 15 as shown in FIG. 3*e* are produced on the circular non-bonded area 14 around the central portion 13 of each of the buttons 12, and the seat shows a beautiful external, appearance analogous to a buttony decoration of a hand-made article of furniture. Further, depending on the seat specification, the circular non-bonded area 14 may be widened to reach the flat portion of the seat surface to further extend the wrinkles 15 thereby enhancing the effect of decoration.

Figure 4A:
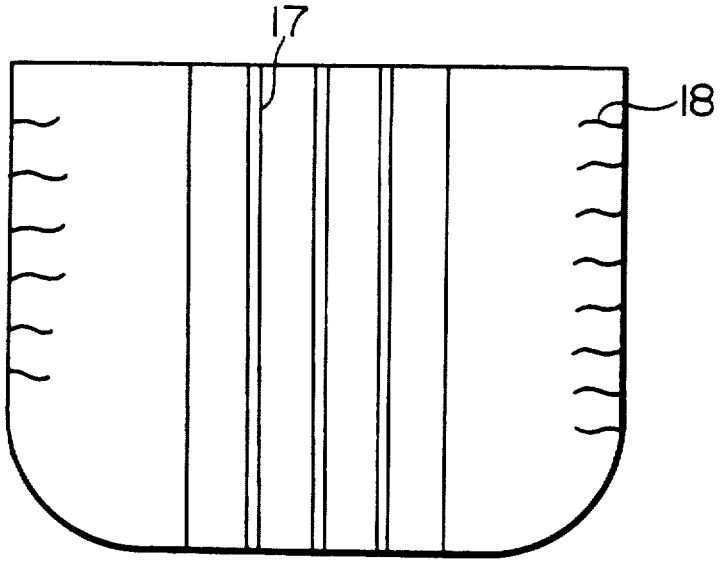
FIG. 4*a* is a schematic plan view of a fourth embodiment of the seat according to the present invention.
Figure 4B:
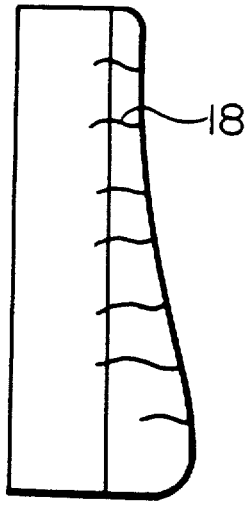
FIG. 4*b* is a schematic side elevation view of the fourth embodiment.
Figure 4C:
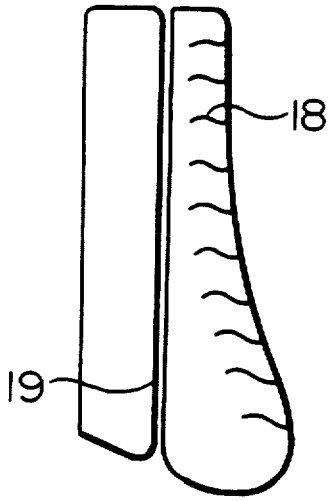
FIG. 4*c* is a schematic side elevation of a modification of the fourth embodiment.
Figure 4D:
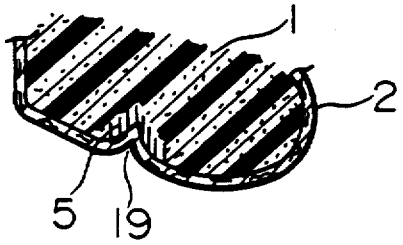
FIG. 4*d* is an enlarged schematic sectional view of part of a modification of the seat shown in FIG. 4*c*.
Figure 4E:
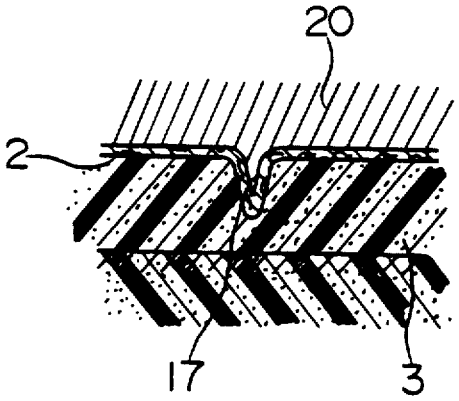
FIGS. 4*e* and 4*f* are schematic sectional views showing means for forming the grooves shown in FIG. 4*a*.
Figure 4F:
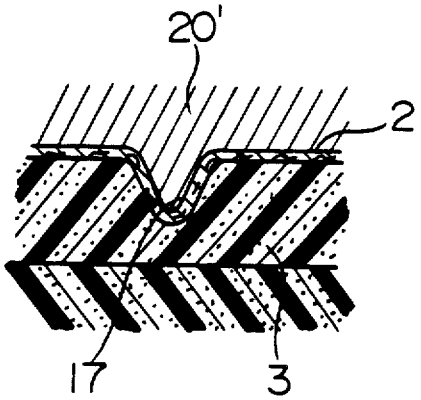
Figure 4G:
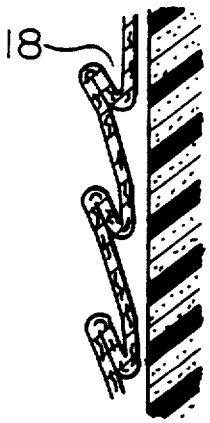
FIGS. 4*g* and 4*h* are schematic sectional views of folds and creases formed in the fourth embodiment respectively.
Figure 4H:
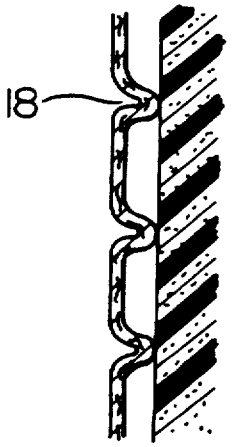

FIGS. 4*a* to 4*h* show a fourth embodiment of the seat according to the present invention and its modifications, and, in FIG. 4*a* to 4*h*, the same reference numerals are used to designate the same parts appearing in FIGS. 1*a* to 1*d*. In the seat shown in FIG. 4*a*, the trim cover is bonded at its seat base part only to the molded polyurethane foam as in the case of the other embodiments. The seat shown in FIG. 4*a* is featured in that a pressing mold 20 as shown in FIG. 4*e* or a pressing mold 20' as shown in FIG. 4*f* is used to form a plurality of sharp cornered longitudinal grooves 17 on the seat base part of the trim cover as shown in FIG. 4*a* and that natural wrinkles 18 are formed on the flap parts and side parts of the trim cover as shown in FIG. 4*b* or 4*c*. These wrinkles 18 have a shape as shown in FIG. 4*g* or 4*h*. These wrinkles 18 may be formed after molding of the molded polyurethane foam or may be previously formed by the use of, for example, a wrinkling machine prior to molding of the molded polyurethane foam. Since the flap parts and side parts of the trim cover having these wrinkles 18 are not bonded to the molded polyurethane foam, the product gives a feeling of softness like that given by gathers or pleats.

FIG. 4*d* shows part of a modification in which a recess 19 is formed on the side part of the trim cover, that is, the side surface of the seat.

In FIG. 4*e* or 4 *f* showing one of the grooves 17 formed by the pressing mold 20 or 20', the grooves 17 are previously formed on the trim cover by means of, for example, high frequency processing, ultrasonic processing or hot pressing. The grooves 17 formed on the trim cover are then fitted on the complementary convex portions of the mold 20 or 20', and, after positioning, the polyurethane resin solution is foamed to form the molded polyurethane foam having the grooves 17 having a sharp configuration. Depending on the design, the portions of the cover member 2 on both sides of each groove 17 may contact each other. The seat surface gives a feeling of soft touch when the filler pad 3, which is soft and has a low specific gravity, is used in combination with the molded polyurethane foam 1 which has a high specific gravity and a high elasticity such as the HR foam. Such a combination is also applicable to a filler pad having buttons.

In the aforementioned embodiments of the present invention, the molded polyurethane foam is integrally combined with the trim cover by foaming the polyurethane resin solution. In lieu of such a molded polyurethane foam, a previously shaped polyurethane foam, a slab or an elastic member obtained by combining and molding fibers as by latex may be used. In such a case, a film of an adhesive material, a heat-fusible powdery material such as nylon or any other suitable adhesive material can be used.

The present invention is not only applicable to seats for use in automotive vehicles but also applicable to various internal articles of vehicles such as door pads, head rests, instrument panels and arm rests and also to various articles of furniture.

It will be understood from the foregoing detailed description that the present invention can provide an excellent product which is free from a fold, a peeling portion, a floating portion, a cave-in and a crease. Even when a cave-in is found in the molded polyurethane foam, it can be easily repaired by stripping off the non-bonded portion of the trim cover. Therefore, the yield rate of the products can be improved, and the reliable products can be offered at a low price.

I claim:

1. A method of forming a seat comprising
(a) setting at rim cover in a molding cavity of a foaming mold;
(b) disposing a film of an adhesive material on an area of the trim cover corresponding to a desired bonded area;
(c) injecting, foaming and molding a polyurethane resin solution onto the trim cover in the mold; and
(d) fusing the film of adhesive material by the temperature of the mold so as to be melted into the molded polyurethane and the trim cover thereby forming a bonded area which is permeable to air.

2. A method according to claim 1 wherein a sheet of non-adhesive material id disposed on the remaining area of the trim cover and is removed after said polyurethane is foamed and molded.

* * * * *